United States Patent [19]

Sadwith

[11] 4,104,080

[45] Aug. 1, 1978

[54] APPARATUS AND METHOD FOR WASHING AND DRYING REUSABLE CONTAINERS

[76] Inventor: Howard M. Sadwith, 16 Fairway E., Colts Neck, N.J. 07722

[21] Appl. No.: 679,317

[22] Filed: Apr. 22, 1976

Related U.S. Application Data

[63] Continuation-in-part of Ser. No. 665,819, Mar. 11, 1976, abandoned.

[51] Int. Cl.[2] ..... B08B 9/00

[52] U.S. Cl. ..... 134/23; 134/25 R; 134/25 A; 134/68; 134/152; 134/170; 198/402

[58] Field of Search ..... 134/25 R, 25 A, 23, 134/29, 30, 32, 66, 67, 68, 72, 82, 83, 125, 127, 152, 170; 198/402, 471; 214/1 Q

[56] References Cited

U.S. PATENT DOCUMENTS

| | | | |
|---|---|---|---|
| 2,023,431 | 12/1935 | McClatchie | 134/66 |
| 2,966,914 | 1/1961 | Sadwith | 134/68 |
| 3,595,251 | 7/1971 | Tarantola | 134/68 |
| 3,614,958 | 10/1971 | Perrier | 134/68 |
| 3,938,533 | 2/1976 | Richard | 134/68 |

*Primary Examiner*—S. Leon Bashore
*Assistant Examiner*—George C. Yeung
*Attorney, Agent, or Firm*—Kenyon & Kenyon, Reilly, Carr & Chapin

[57] ABSTRACT

An apparatus and method for washing and drying reusable containers are disclosed. In the apparatus and method, the containers to be cleaned, after successively passing through washing and rinsing stations, are, thereafter, flipped by 180° before passing through a drying station. This flipping action, which abruptly turns the containers end over end, causes a significant amount of excess fluid to be shaken from the containers. As a result, drying of the containers when passing through the drying station is greatly facilitated.

In a further aspect of the apparatus and method of the invention, the containers after flipping are initially moved at a faster speed than a first speed associated with their passage through the washing and rinsing stations and, thereafter, moved through the drying station at a speed between the aforesaid two speeds. In this manner, the rate at which containers can be delivered to the apparatus can be increased without any appreciable adverse effect on the flipping and drying operations.

26 Claims, 6 Drawing Figures

APPARATUS AND METHOD FOR WASHING AND DRYING REUSABLE CONTAINERS

This application is a continuation-in-part of application Ser. No. 665,819, filed on Mar. 11, 1976, now abandoned.

BACKGROUND OF THE INVENTION

The invention pertains to an apparatus and method for automatically cleaning reusable cartons, containers and similar articles and, in particular, an apparatus and method in which such cleaning is achieved in a more efficient and less space consuming manner.

Techniques for automatically cleaning articles such as cartons, cases or pans are known in the art. In one prior art technique designed to conserve space, the apparatus embodying the technique comprises upper and lower vertically and horizontally aligned chambers or channels. The upper chamber is the cleaning chamber of the apparatus and includes an upper conveyor for successively transporting the articles through washing and rinsing stations disposed adjacent the conveyor. The lower chamber, on the other hand, is the drying chamber of the apparatus. It includes a lower conveyor moving opposite to the upper conveyor which conveys the rinsed articles through a drying station.

For transporting the rinsed articles from the upper chamber to the lower chamber, the apparatus further includes an inclined conveyor horizontally aligned with two chambers and having one end adjacent the delivery end of the upper conveyor and the other end adjacent the receiving end of the lower conveyor. In particular, the inclined conveyor is positioned at an acute angle relative to the upper conveyor so that the articles at the delivery end of the upper conveyor tip downwardly as their bottoms engage the top of the inclined conveyor. The articles are thus gradually turned upside down (rotated by 180° relative to a horizontal axis transverse to the upper and lower conveyors) by the inclined conveyor and are delivered upside down to the delivery end of the lower conveyor. The latter conveyor then carries the articles through the drying station where they are completely dried.

As can be appreciated, in the aforesaid prior art system, during the gradual 180° rotation of the articles by the inclined conveyor, some drainage of the rinsing liquid carried by the articles as a result of their passing through the rinsing station is caused to occur. However, the extent of such drainage is limited by the gradual manner in which the pans are turned.

It is, therefore, an object of the present invention to provide an improved automatic washing and drying apparatus and method which use a limited degree of space, but which have increased drainage capabilities in passing rinsed containers to a drying station.

It is also a further object of the present invention to provide an automatic washing and drying apparatus and method in which a simple and less complicated means is employed for conveying rinsed containers to a drying station.

SUMMARY OF THE INVENTION

In accordance with the principles of the present invention, the above and other objectives are accomplished by an apparatus and method in which the containers to be cleaned, after successively passing through washing and rinsing stations, are, thereafter, flipped by 180° before passing through a drying station. This flipping action, which abruptly turns the containers end over end, causes a significant amount of excess rinsing fluid to be shaken from the containers. As a result, drying of the containers when passing through the drying station is greatly facilitated.

In further accordance with the principles of the invention, the washing and drying apparatus of the invention comprises an upper cleaning chamber and a lower drying chamber which are offset or horizontally displaced one from the other and which are adapted to receive and transport containers on their sides in opposite directions. Disposed between and communicating with the aforesaid chambers is a container transfer assembly designed to convey containers from the upper chamber to the lower chamber while flipping them 180°, so they move through the lower chamber on their opposite sides.

More specifically, the transfer assembly includes an inclined chute which is arranged with its upper end at a region in the upper chamber at which containers after rinsing are delivered and with its lower end at a region in the lower chamber at which containers to be dried are received. A pushing device for the transfer assembly is located adjacent the aforesaid region in the upper chamber and applies a force to each container above the container's center of gravity, thereby pushing the container onto the chute. Additionally, a slanted wall or plate portion of the assembly is included in the receiving region of the lower chamber for aiding the chute to right each container as the container proceeds from the chute into the lower chamber.

In the particular illustrative embodiment to be described, the pushing mechanism is formed by the end portions of a plurality of guide rods which guide the containers through the upper chamber and which extend outwardly in the transfer region.

In a further aspect of the invention, the apparatus and method are modified so as to permit a relative increase in the number of containers which can be washed and dried without any appreciable disturbance on the flipping and drying operations. More particularly, this is accomplished by initially moving the containers after flipping at a faster speed than the speed at which they are moved when passing through the washing and rinsing stations and, thereafter, moving the containers through the drying station at a speed between the aforesaid two speeds.

BRIEF DESCRIPTION OF THE DRAWINGS

The above and other features and aspects of the present invention will become more apparent upon reading the following detailed description in conjunction with the accompanying drawings, in which.

DETAILED DESCRIPTION OF THE DRAWINGS

Figure 1:
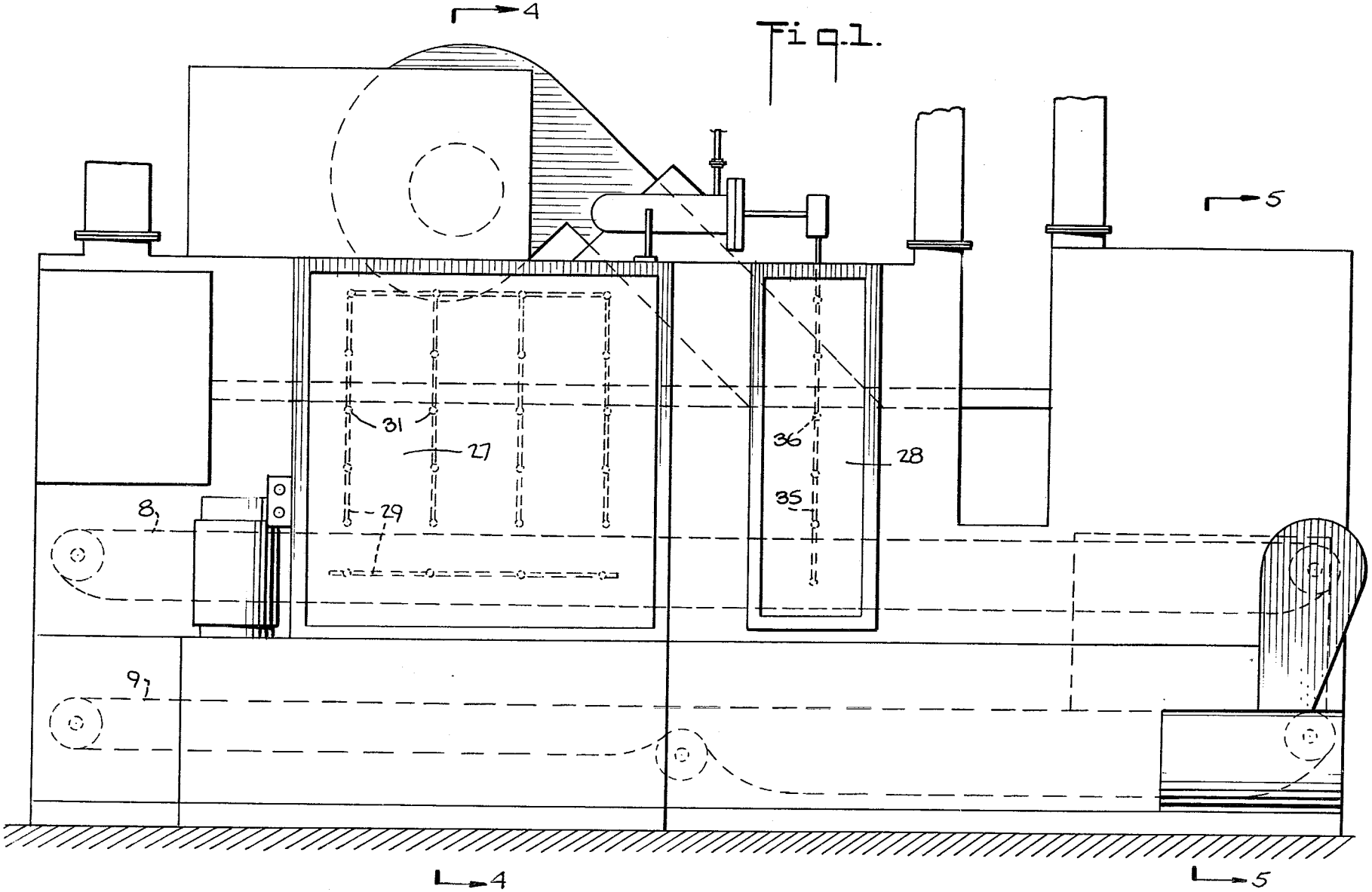
FIG. 1 illustrates a side elevation view of a washing and drying apparatus in accordance with the principles of the present invention.
Figure 2:
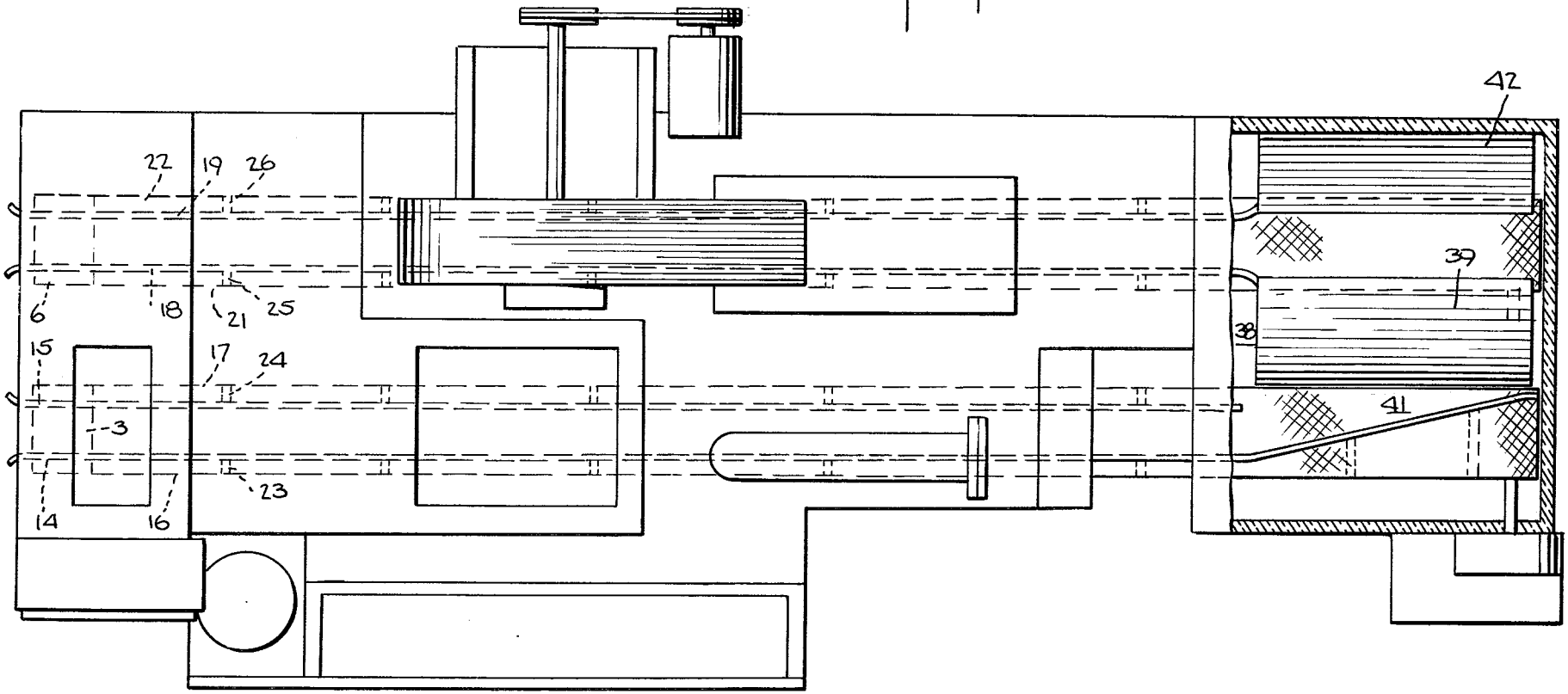
FIG. 2 illustrates a top plan view of the apparatus of FIG. 1.
Figure 3:
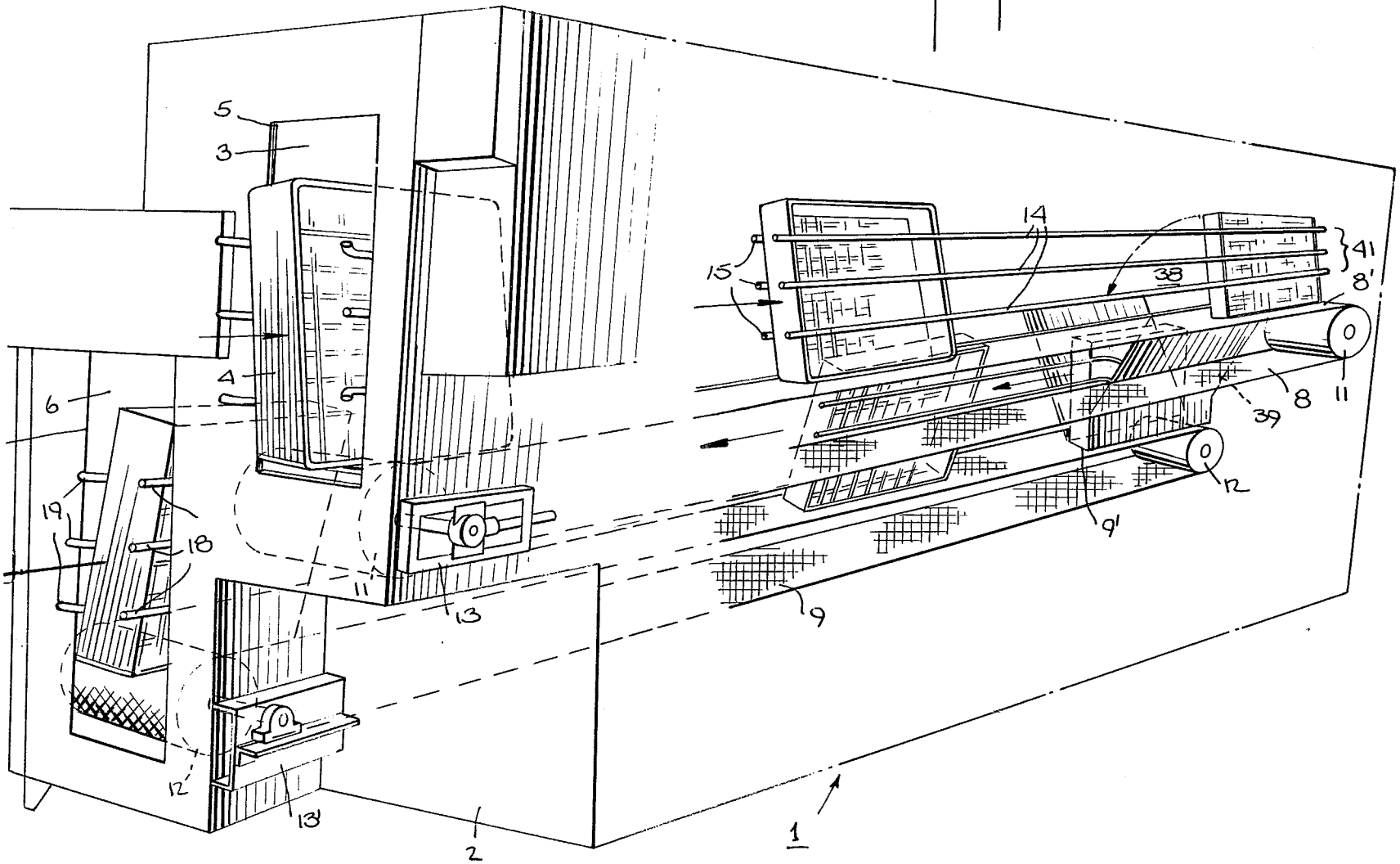
FIG. 3 shows a partially pictorial view of the apparatus of FIG. 1.

Referring to FIGS. 1 to 3, there is shown a container washing and drying apparatus 1 in accordance with the principles of the present invention. As shown, the apparatus comprises a housing 2 which has an upper cleaning chamber 3 for receiving containers 4 on their sides through an entrance opening 5, and a lower drying chamber 6 for passing containers from the housing via an exit opening 7. The containers 4 are carried through the chambers 3 and 6 in opposite directions by way of transport conveyors which are illustratively depicted as endless belt conveyors 8 and 9. Each of these conveyors is driven by a pair of rotating sprocket wheels, one of which may, for example, be rotatably mounted at one end and the other at the other end of their respective chamber. In particular, the wheels 11 driving the conveyor 8 rotate so that the conveyor 8 carries the containers 4 into the chamber 3, and the wheels 12 driving conveyor 9 rotate in the opposite direction so that the latter conveyor carries the containers 4 out of the chamber 6. Each of the pairs of wheels 11 and 12 may, in turn, be driven in any conventional manner as for example, by a motor and appropriate coupling linkage, linking the motor to the respective wheels. Although not specifically shown, the direct drive for the pairs of wheels 11 and 12 is situated at the rear of the housing 2 and directly drives the wheels of each pair farthest from the entrance and exit openings.

As can be seen, the containers 4 are carried by the conveyors 8 and 9 on their narrower sides and with their wider bottoms extending adjacent the chamber walls. This permits the chambers and, thus, the entire apparatus to be of relatively narrow construction. As a result, the overall space requirements for the machine are significantly reduced.

In moving through the chambers 3 and 6, the containers are also guided by pluralities of rods disposed on opposing sides of the chambers and extending therealong. In particular, as can be seen in FIGS. 2 and 3, first and second pluralities of rods 14 and 15 are disposed adjacent the side walls 16 and 17, respectively, of chamber 3, while third and fourth pluralities of rods 18 and 19 are disposed adjacent the side walls 21 and 22, respectively, of chamber 6.

These pluralities of rods, in turn, are supported by pluralities of horizontally extending members 23, 24, 25 and 26, respectively, which are supported by the chamber sidewalls and connect to the rods. As can be appreciated, the lengths of the latter members are selected so as to space the opposing pluralities of guide rods such that the containers 4 moving through the chambers are prevented from sliding downward and becoming wedged therein. As may be also noted, at the entrance and exit openings the rods 14, 15, 18, and 19 are bent away from their respective chambers. This facilitates movement of the containers 4 into and out of the chambers via the entrance and exit openings.

Figure 4:
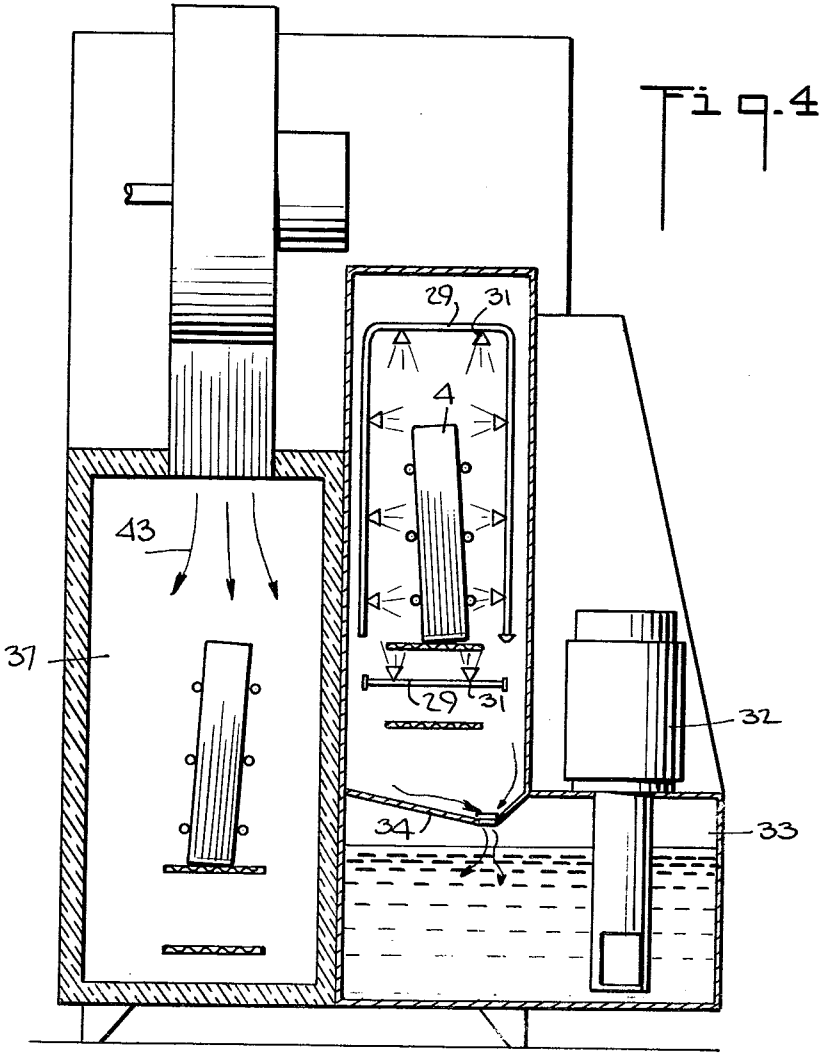
FIG. 4 shows a vertical cross section of the apparatus of FIG. 1 taken so as to render visible the washing and drying stations of the apparatus.

As can be seen from FIG. 1, the conveyor 8 transports the containers 4 through successive work stations 27 and 28 disposed adjacent the conveyor. Work station 27 is a washing station which, as shown, includes a plurality of headers 29 arranged in a conventional manner to spray washing fluid via pluralities of jet nozzels 31 onto the containers. As indicated in FIG. 4, the washing fluid for the headers 29 at station 27 is provided in a conventional manner through conduit (not shown) which connects to a pump 32 which draws water from a tank 33 containing the fluid. Excess fluid is also drained from the chamber 3 by a slanted drain board 34 which conveys such fluid through a mesh strainer basket and back to the tank 33.

After passage through washing station 27, the conveyor 8 carries the containers 4 through the second working station 28 which is a rinsing station. This station, as shown in FIG. 1, includes a header 35 having jet nozzles 36 thereon. Rinsing fluid can be provided to the header 35 also in a conventional manner as, e.g., through conduit coupled to an outside source of water supply. The rinsing fluid is sprayed from the nozzles 36 onto the containers 4 as they are conveyed on their sides through the station. Thus, the containers 4, after passage through rinsing station 28, carry an excess of rinsing fluid which must be removed in the drying station 37 (FIG. 4) of the apparatus located adjacent the lower chamber 6.

In accordance with the invention, the aforesaid drying operation is greatly facilitated by providing a mechanism for transporting the containers from the upper cleaning chamber 3 to the lower drying chamber 6 in such a manner as to shake the excess rinsing fluid free from the containers. In particular, a container transfer assembly 38 is included in the apparatus 1 so as to receive rinsed containers delivered by the conveyor 8 in the chamber 3 and transport such containers to the conveyor 9 in the chamber 6 for subsequent drying in the drying station 37. The assembly 38 is thus located adjacent the chambers 3 and 6 rearward of the respective stations 28 and 37.

Figure 5:
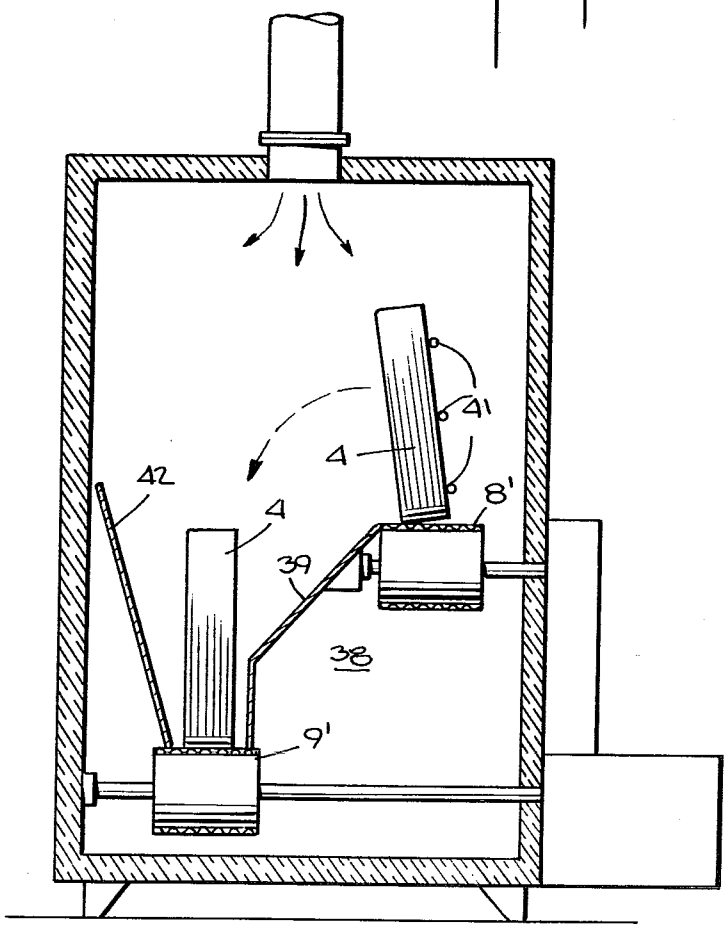
FIG. 5 illustrates a vertical cross section through the rearward portion of the apparatus of FIG. 1 which permits viewing of the container transfer mechanism of the apparatus.

More specifically, as shown in FIGS. 1, 2 and 5 the assembly 38 includes an inclined member or chute 39 which is adjacent to and receives rinsed containers from the delivery end 8′ of the conveyor 8. At this point in the chamber 3, the side wall 17 and the plurality of guides 15 terminate so as to permit the chute 39 to extend to or communicate with the chamber 3 and, thus, the conveyor 8. The other or lower end of chute 39, in turn, is arranged adjacent the receiving end 9′ of conveyor 9, at which end of the conveyor 9 the upper portion of the side wall 21 and the guides 18 of the chamber 6 terminate. The chute 39 thus provides a direct path for transporting containers from the aforesaid delivery end 8′ to the receiving end 9′ of the respective conveyors 8 and 9.

The assembly 38 also includes a pushing mechanism 41 which is also disposed adjacent the discharge end 8′ of conveyor 8. As shown, the mechanism 41 is formed by the portions of the plurality of rods 14 which are on side wall 16 of chamber 3 opposite the chute 39. More particularly, these portions of the rods 14 are bent outwardly from the wall 16 so as to extend further into the chamber 3 than at the other portions of the chamber.

As can be appreciated, the aforesaid bend in the rods 14 causes each container 4 being delivered at the delivery end 8′ of conveyor 8 to receive a force above its center of gravity, thereby pushing and rotating the container about the side upon which it is being transported. This rotation, in turn, causes the container to topple away from the wall 16 onto the chute 39 so that it now slides on its bottom and proceeds down the chute with its opposite side now leading. When a container on the chute 39 reaches the lower end of the chute, the upper portion of its leading side is engaged by a further portion of assembly 38. This portion of assembly 38 is formed by a slanted wall portion 42 of side wall 22 of chamber 6. Upon engagement of the container with the slanted wall portion 42 the upper portion of the leading side is caused to slide downward as the remaining portion of the side comes in contact with the receiving end 9' of conveyor 9. This downward movement results in the container righting itself so that it now moves on the receiving end with the aforesaid opposite side resting on the conveyor. As the conveyor 9 moves the container 4 from the receiving end 9', the container is then engaged by guide rods 18 and 19 and moved through the lower chamber 6 on its opposite side.

As can be appreciated, the transfer of the rinsed containers 4 from the chamber 3 to the chamber 6 by the assembly 38 results in the containers being rotated 180° about an axis parallel to their direction of travel through a flipping type action initiated by the toppling of the containers sideways onto chute 39. Such flipping action, in turn, results in a portion of the rinsing fluid held on the containers being removed therefrom as if the containers had been manually shaken. Thus when the containers 4 move from the receiving end 9' of conveyor 9 and are engaged by the rods 18 and 19 there is now a significantly lesser degree of rinsing fluid remaining thereon to be evaporated or blown off when the containers pass adjacent the drying station 37.

More particularly, upon being transferred to the conveyor 9 of chamber 6, the containers 4 are transported by the conveyor through drying station 37 where, as shown in FIG. 4, hot air 43 from a duct 44 is applied to the tops, bottoms and sides of the containers. Typically, hot air can be supplied to duct 44 in any conventional manner as by a plenum chamber which draws air therein via a fan and heats such air by a gas burner or any other heating means such as, for example, steam or electricity.

After leaving station 37 the containers 4, which are now fully dried, are carried by conveyor 9 through the chamber 6 to the exit opening 7, where they can now be removed from the apparatus and reused.

Figure 6:
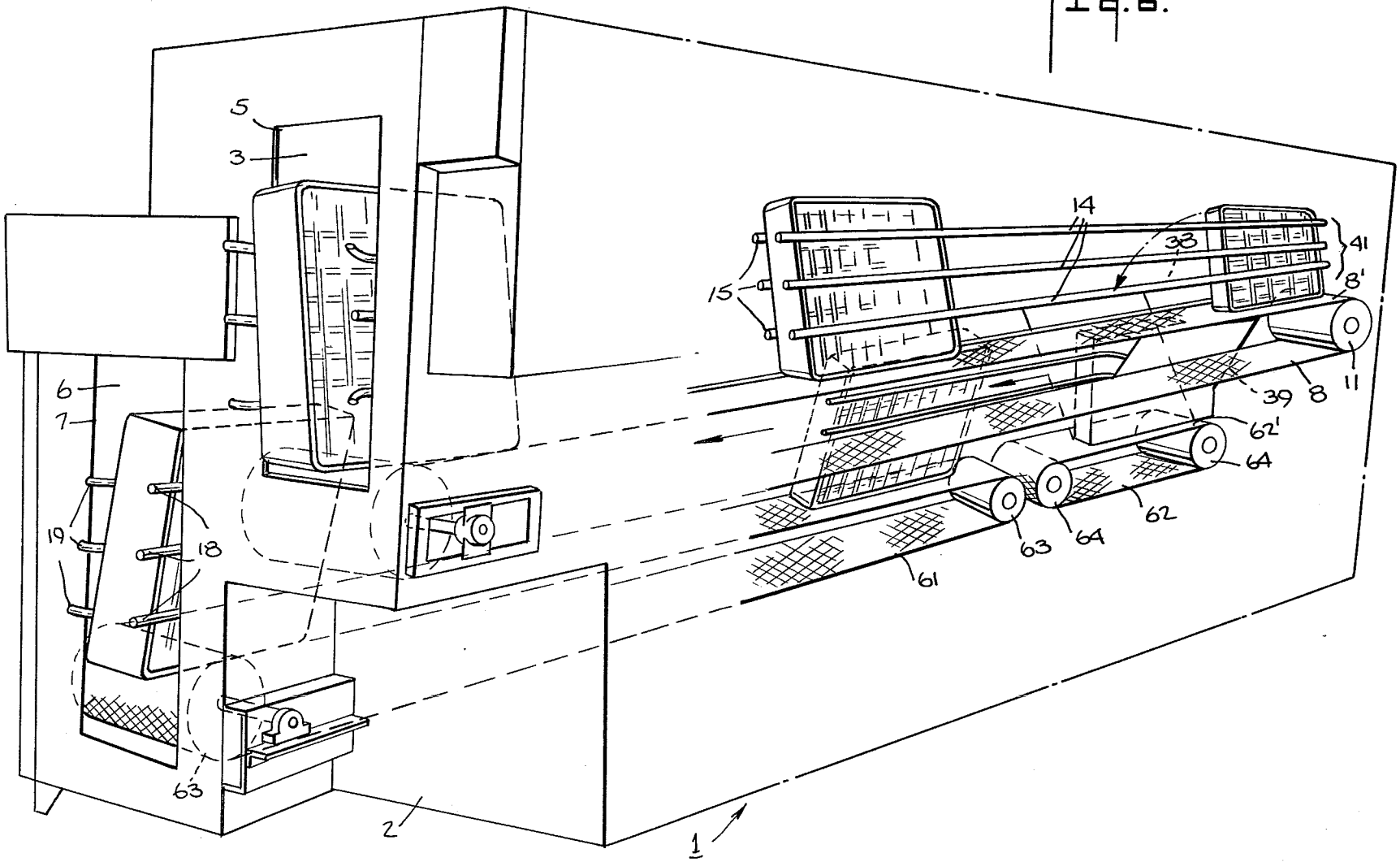
FIG. 6 shows a partially pictorial view of a second embodiment of a washing and drying apparatus in accordance with the principles of the present invention.

FIG. 6 shows the apparatus of FIGS. 1–5 modified so as to permit a relative increase in the number of containers 4 passing through the apparatus, without appreciably disturbing the flipping and drying operations thereof. More particularly, the apparatus of FIG. 6 is essentially similar to the apparatus of FIG. 3 with the exception that the conveyor in chamber 6 has been modified so as to include two separate conveyors 61 and 62. The latter conveyors are arranged one behind the other and are driven by respective pairs of sprocket wheels 63 and 64 so as to move containers placed thereon toward the exit opening 7.

More specifically, the conveyor 62 is disposed rearward of the conveyor 61 in the chamber 6 and includes a portion 62' which is adjacent to and receives containers from the chute 39 of the flipping assembly 38. The conveyor 61, on the other hand, receives the flipped containers carried by the conveyor 62 and carries such containers through the drying station and, thereafter, to the exit opening 7.

In accordance with this aspect of the invention, the speeds of the conveyors 61 and 62 relative to the speed of the conveyor 8 are selected so as to permit a relative increase in the number of containers passing through the apparatus, without appreciably disturbing the drying and flipping operations of the apparatus. More specifically, the speed of the conveyor 62 is selected to be greater than the speed of the conveyor 8 while the speed of conveyor 61 is selected to be between the speeds of the latter two conveyors. In particular, it has been found preferable to select the speed of conveyor 62 to be substantially greater, i.e., to be about twice as great as that of conveyor 8 and to select the speed of conveyor 61 to be slightly greater, i.e., about 10 percent greater, than that of conveyor 8.

With the speed for the conveyor 62 selected to be substantially greater than that of the conveyor 8, it can be appreciated that the containers 4 will be moved from the region in the lower chamber adjacent the chute 39 at a substantially more rapid rate than they are being moved into the region in the upper chamber adjacent such chute. As a result, the rate in the upper chamber at which containers are delivered to the chute 39 can now be increased over that realizable when the conveyors in two chambers are delivering containers to and taking containers away from the chute 39 at the same rate. Moreover, by selecting the speed of the conveyor 61 to be only slightly greater than the speed of the conveyor 8, the containers 4 are still moved through the drying station at a slow enough rate for the containers to be adequately and thoroughly dried.

With the apparatus of FIG. 6, the containers 4 can thus now be delivered into the apparatus at a faster rate and, hence, can be more closely packed on the conveyor 8, without disturbing the subsequent flipping and drying operations of the apparatus.

In all cases, it is understood that the above-described arrangements are merely illustrative of the many possible specific embodiments which represent applications of the present invention. Numerous and varied other arrangements can readily be devised in accordance with the principles of the present invention without departing from the spirit and scope of the invention.

What is claimed is:

1. Apparatus for washing and drying reusable container-like articles comprising:

a washing station including means for applying a washing fluid to articles transported thereto;

a rinsing station including means for applying rinsing fluid to articles transported thereto;

first transport means for successively transporting said articles to said washing and rinsing stations, said first transport means having a delivery end to which said articles are delivered after transport to said washing and rinsing stations;

a drying station including means for drying articles;

a second transport means for transporting said articles to said drying station, said second transport means having a receiving end at which said articles arrive prior to transport to said drying station, said receiving end being horizontally displaced from and vertically displaced below said delivery end;

and a transfer means for conveying said articles from said first transport means to said second transport means after said articles have been transported to said rinsing station, said transfer means including means for flipping said articles so as to abruptly rotate said articles end over end to shake excess rinsing fluid carried thereby therefrom, said means for flipping comprising:

a chute having one end disposed adjacent said delivery end of said first transport means and the other end disposed adjacent said receiving end of said second transport means; and means disposed adjacent said delivery end of said first transport means for pushing said articles from said first transport means onto said chute.

2. Apparatus in accordance with claim 1 in which said means for flipping rotates said articles through an angle of 180°.

3. Apparatus in accordance with claim 2 in which said rotation of said articles is about an axis parallel to the direction of travel of said articles when said articles are transported on said first transport means.

4. Apparatus in accordance with claim 1 in which said means for pushing applies a force to said articles above the center of gravity thereof, whereby said containers are caused to rotate and fall onto said chute.

5. Apparatus in accordance with claim 1 in which said means for flipping further includes:

a wall disposed adjacent said receiving end opposite said chute and inclined away therefrom, whereby said articles being carried by said chute engage said wall and are urged thereby onto said second transport means.

6. Apparatus in accordance with claim 1 in which said articles are containers having sides which are narrower than their bottoms and said containers are transported on their sides on said first and second transport means.

7. Apparatus in accordance with claim 1 further including:

a first upper chamber through which said first transport means moves and adjacent which said washing and rinsing stations are disposed, said upper chamber having an opening adjacent said delivery end of said first transport means;

and a second lower and laterally displaced chamber through which said second transport means moves and adjacent which said drying station is disposed, said second chamber having an opening adjacent said receiving end of said second transport means.

8. Apparatus in accordance with claim 7 in which:

said first and second transport means comprise first and second conveyors, respectively;

and said one end of said chute is disposed adjacent said first conveyor and said other end of said chute is disoposed adjacent said second conveyor.

9. Apparatus in accordance with claim 1 further including:

guide means running adjacent said first transport means for guiding said articles when transported thereon, said guide means being adapted adjacent said delivery end to form said pushing means.

10. Apparatus in accordance with claim 9 in which said guide means comprises:

first and second pluralities of elongated rods disposed on opposite sides of said first transport means, the portions of said first plurality of rods in the region of said delivery end being opposite said chute and being bent toward said chute to thereby form said pushing means.

11. Apparatus in accordance with claim 10 further including:

third and fourth pluralities of rods disposed on opposite sides of said second transport means for guiding said articles when transported thereon.

12. Apparatus in accordance with claim 10 in which at least one of said portions is located above the center of gravity of said articles.

13. Apparatus in accordance with claim 1 in which said second transport means includes:

a first conveyor means for receiving said articles from said first transport means, said first conveyor means moving said articles at a speed greatr than that at which said first transport means moves said articles.

14. Apparatus in accordance with claim 13 in which said second transport means includes:

a second conveyor means for receiving said articles from said first conveyor means and transporting them to said drying station.

15. Apparatus in accordance with claim 14 in which said second conveyor means moves said articles at a speed between those at which said first transport means and said first conveyor means move said articles.

16. Apparatus in accordance with claim 15 in which:

said first conveyor means transports said articles at a speed which is substantially greater than that at which said first transport means transports said articles and said second conveyor means transports said articles at a speed which is slightly greater than that at which said first transport means transports said articles.

17. Apparatus in accordance with claim 16 in which:

said first conveyor means transports said articles at a speed which is approximately twice that at which said first transport means transports said articles and said second conveyor means transports said articles at a speed which is approximately 10 percent greater than that at which said first transport means transports said articles.

18. A method for washing and drying reusable container-like articles comprising the steps of:

transporting said articles through a washing station for applying washing fluid thereto;

transporting said articles through a rinsing station for applying rinsing fluid thereto;

flipping said rinsed articles so as to abruptly rotate said articles end over end to shake a portion of the excess rinsing fluid on said articles therefrom, the flipping of said articles comprising:

pushing said articles onto an inclined chute;

and righting said articles when they reach the end of said chute;

and transporting said flipped articles through a drying station for drying said articles.

19. A method in accordance with claim 18 in which said step of flipping comprises rotating said articles through an angle of 180°.

20. A method in accordance with claim 19 in which said rotating of said articles is about an axis parallel to the direction of movement of said articles.

21. A method in accordance with claim 18 in which the step of pushing includes:

applying a force to the articles at a point above their center of gravity.

22. A method in accordance with claim 18 in which the step of righting said articles includes:

bringing said articles into engagement with a wall disposed adjacent to and inclined away from the end of said chute.

23. A method in accordance with claim 18 in which the step of transporting said flipped articles includes the step of:

conveying said flipped articles at a speed greater than that at which said articles are transported through said washing and rinsing stations.

24. A method in accordance with claim 18 in which the step of transporting said flipped articles includes the steps of:

conveying said flipped articles at a speed greater than that at which said articles are transported through said washing and rinsing stations immediately after said articles are flipped and, thereafter, conveying said articles through said drying station at a speed between said greater speed and said speed at which said articles are transported through said washing and rinsing stations.

25. A method in accordance with claim 24 in which:

said greater speed and said speed at which said articles are transported through said drying station are substantially greater and slightly greater, respectively, than the speed at which said articles are transported through said washing and rinsing stations.

26. A method in accordance with claim 25 in which:

said greater speed and said speed at which said articles are transported through said drying station are approximately twice as great and 10 percent as great, respectively, as the speed at which said articles are transported through said washing and rinsing stations.

* * * * *